US009476270B2

(12) United States Patent
Istre et al.

(10) Patent No.: US 9,476,270 B2
(45) Date of Patent: Oct. 25, 2016

(54) HIGH ENERGY IN-LINE HYDRAULIC SHEARING UNIT FOR OILFIELD DRILLING FLUIDS

(75) Inventors: Randolph Paul Istre, Lafayette, LA (US); Kazi M. Rashid, Spring, TX (US); Timothy N. Harvey, Humble, TX (US); Harry Todd Lynch, Broussard, LA (US); Michael Alan Moore, Houma, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 749 days.

(21) Appl. No.: 13/286,801

(22) Filed: Nov. 1, 2011

(65) Prior Publication Data

US 2013/0105164 A1 May 2, 2013

(51) Int. Cl.

| | |
|---|---|
| ***E21B 43/20*** | (2006.01) |
| ***E21B 43/16*** | (2006.01) |
| ***E21B 21/06*** | (2006.01) |
| ***B01F 5/02*** | (2006.01) |

(52) U.S. Cl.
CPC ..... *E21B 21/062* (2013.01); *B01F 5/0256* (2013.01)

(58) Field of Classification Search
CPC ..... E21B 21/062; B01F 5/0256
USPC ..... 166/222, 305.1; 175/65, 67, 70; 239/1, 239/11, 422, 423, 428, 548, 561, 566; 366/162.4, 173.2
See application file for complete search history.

(56) References Cited

U.S. PATENT DOCUMENTS

| | | | | |
|---|---|---|---|---|
| 2,597,422 | A * | 5/1952 | Wood | 241/16 |
| 4,026,817 | A * | 5/1977 | Ciuti et al. | 516/53 |
| 5,586,608 | A | 12/1996 | Clark et al. | |
| 2004/0023817 | A1 | 2/2004 | Taylor et al. | |
| 2007/0181158 | A1 | 8/2007 | Bozak et al. | |
| 2007/0278327 | A1* | 12/2007 | Wolfe | 239/398 |
| 2008/0049544 | A1* | 2/2008 | Bingham et al. | 366/101 |
| 2010/0236633 | A1 | 9/2010 | Esparza et al. | |

OTHER PUBLICATIONS

Newman, Katerina, Lomond, Perry, Jones, Brad, McCosh, Karen, and M-I Swaco, Advances in Drilling Fluid Preparation and Conditioning at Fluid Mixing Facilities, AADE-10-DF-HO-48, Presented at AADE Fluids Conference and Exhibition, Apr. 6-7, 2010, held in Houston, Texas.
International Search Report dated Jan. 16, 2014 for Application No. PCT/US2012/063071.
Written Opinion dated Jan. 16, 2014 for Application No. PCT/US2012/063071.
Office Action issued in related Canadian patent application No. 2,848,734, mailed on Oct. 14, 2015 (4 pages).

* cited by examiner

*Primary Examiner* — Nicole Coy
(74) *Attorney, Agent, or Firm* — Tenley R. Krueger; Baker Botts L.L.P.

(57) ABSTRACT

Disclosed is an apparatus and method for shearing well drilling fluid mixtures containing an emulsifier, and utilizing pumping the fluids through a plurality of nozzles, reducing the size of the fluid droplets as they pass through the nozzles, discharging the fluid droplets into a output chamber where the emulsifier surrounds the smaller droplets with the nozzle discharges aligned to intersect in the stabilization chamber.

19 Claims, 3 Drawing Sheets

HIGH ENERGY IN-LINE HYDRAULIC SHEARING UNIT FOR OILFIELD DRILLING FLUIDS

CROSS REFERENCE TO RELATED APPLICATIONS

None.

BACKGROUND

Technical Field

This invention relates, generally, to apparatus and methods used in hydrocarbon well drilling and servicing. More specifically, this invention relates to an apparatus for hydraulic shearing of oilfield drilling fluids.

SUMMARY OF THE INVENTIONS

A common problem encountered in drilling and servicing hydrocarbon wells is found when shearing water-based, oil-based and synthetic-based drilling fluids. For example, invert emulsion drilling fluids are difficult to shear because of the high shear values required to effectively emulsify the discontinuous phase (water droplets) in the continuous phase (oil) and the difficulty encountered in obtaining acceptable rheological properties of the invert emulsion drilling fluid, using a combination of organophilic clays, the surface area of the emulsified water and other rheology modifiers for suspension properties. As the water droplets become smaller, the quantity of droplets and their combined surface area will increase, thereby changing the rheological profile of the fluid. Many synthetic-based invert emulsion drilling fluids for deep-water applications have been specifically designed to have a low equivalent circulating density (ECD) and low plastic viscosity (PV). These fluids have no organophilic clays or organophilic lignite to help suspend commercial solids. These drilling fluids frequently have other constituents, such as, rheology modifiers, filtration control agents, osmotic balance agents, wetting agents, base oil, organic polymers and surfactants, which require relatively high energy to create a stable emulsion with acceptable rheology for suspension of commercial solids. A Rheology Modifiers is a chemical additive that affects change in the gel strength, viscosity, or flow characteristics of a drilling fluid. Examples include: Oligophilic clays, Resins, Dimer/trimer fatty acids, and synthetic polymers. A Filtration Control Agent is a chemical additive that reduces the ability for liquids in a slurry to move through a filter cake in the presence of differential pressure, into a formation being drilled. Examples include Synthetic Polymers, Organophilic clays, Organophilic Lignitic materials and Asphaltenes. A Wetting Agent is a chemical that reduces the inclination of a solid to repel the drilling fluid or in this iteration, enhances the propensity of a solid to exhibit an oil-wet surface. Examples include Soy lecithin and synthetic surfactants. And Osmotic Balance Agent is chemical, usually a water soluble salt, that dissolves in the water phase of an invert-emulsion drilling fluid which then exhibits osmotic imbalance across the emulsifier membrane with the water held in the formation being drilled, thereby creating an osmotic pressure imbalance. Examples include Calcium Chloride, Sodium Chloride and Sodium Nitrate. An Emulsifier is a surface active agents that assist in forming a stable emulsion. Examples include Tall Oil Fatty Acids and Synthetic Surfactants. A Base Oil is the continuous phase of an invert emulsion—a blend of hydrocarbon liquids ranging from C-8 through approximately C-36 that possess desirable flow properties under a wide range of temperatures. Examples include Diesel Oil, Linear Paraffins, Poly Alfa Olefins, and certain esters of Palm Oil.

Once the constituents of invert emulsion fluids are combined, the production of fine droplets from the discontinuous phase by methods requires enough energy input to exceed a critical power density. Critical power density will vary with the surface tensions of the two liquids. In this example, the two liquids are a base oil (the continuous phase) and water (the discontinuous phase). Droplet size and size distribution will vary with the type of flow, e.g., turbulent or laminar elongational. The emulsifier in the continuous phase prevents the small droplets just created from coalescing, thereby creating a stable emulsion. The present invention device relies predominantly upon laminar elongational flow to create droplets less than 1 μm. Historically, most shearing devices relied upon inertial forces in turbulent flow to shear these fluids and to create small droplets. Some of the mechanical shear inducing devices were able to provide acceptable shear of the fluid but required repeated circulation of the fluid mixture to obtain measurable improvement and were time-consuming or expensive to use. Other devices using various pump types aimed the fluid discharge against metal plates or created tortuous path shearing to shear by inducing turbulent flow. The vast majority of these so-called shearing devices are not able to provide sufficient energy density to create the fine droplets required to produce a stable water-in-oil emulsion and are only marginally better at providing enhanced mixing as a result of their reliance upon a turbulent flow regime. High shear, efficiently executed, translates into the ability to obtain acceptable rheological results with less chemical addition. It is, therefore, desirable to provide a drilling fluid shearing method or device able to provide acceptable levels of dispersion and shear with little or no recycling time, using the least amount of commercial product to obtain desirable fluid properties.

The method and apparatus of the present invention effectively produces very fine droplets of a size less than about 3 μm and preferably less than about 1 μm. These <1 μm droplets are created by a combination of viscous and/or inertial forces while in a laminar elongated flow. The combination of these two disruptive forces imparts high hydraulic shear in a single pass through the apparatus to all types and density ranges of drilling fluids, with or without solids. As a result, the apparatus is able to provide efficient shear in a timely manner.

According to the methods of one embodiment of the present invention, the multi-constituent drilling fluid mixture is raised in pressure and divided into a plurality of streams. Each drilling fluid stream is fed through a nozzle where the flow velocity of the stream is increased. While passing through these nozzles, the velocity is increased in such a manner as to elongate the individual droplets of water and chemical additives such that the droplets tend to divide into multiple, smaller, individual droplets of water or other additives. The additional surface area produced by these more numerous and smaller water droplets attract chemical emulsifiers while enhancing the stability and the properties of the fluid being designed and built. The streams are discharged from the nozzle at this higher flow velocity with at least two of the higher velocity streams intersecting while the static pressure is lowered. The apparatus of the present invention comprises a drilling fluid shearing housing, having an inlet for receiving drilling fluid from a high pressure pump. The inlet leads to an interior chamber with a plurality of nozzles in fluid communication with the inlet. In this embodiment, at least two of the nozzles are aligned so that the smaller droplets discharged from the nozzles intersect in a low pressure chamber where the emulsion, in the presence of adequate emulsifiers, becomes stable.

BRIEF DESCRIPTION OF THE FIGURES

The advantages and features of the present invention can be understood and appreciated by referring to the drawings of examples attached hereto, in which.

DETAILED DESCRIPTION OF THE INVENTIONS

Figure 1:
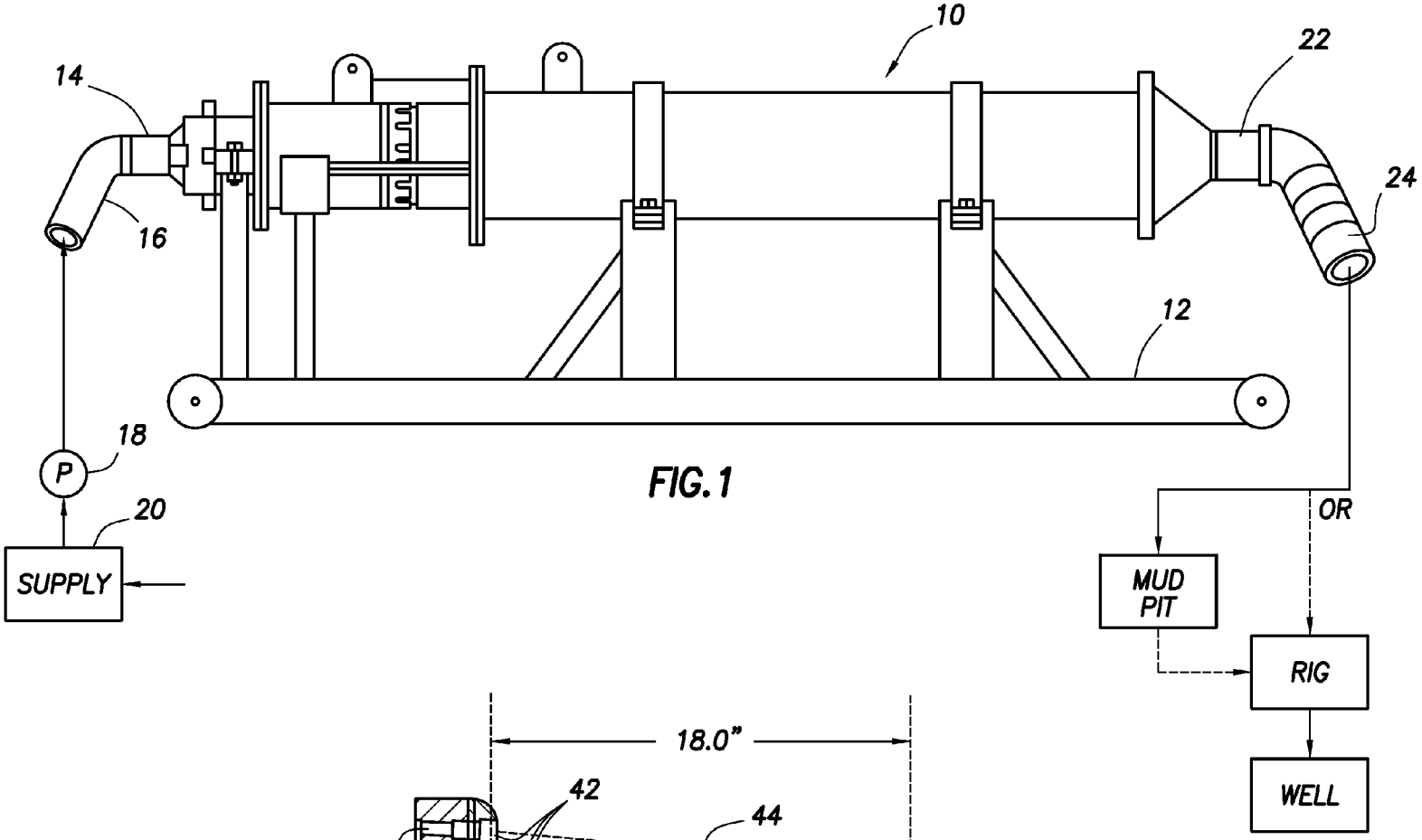
FIG. 1 is a side elevation view of one embodiment of the high energy in-line hydraulic shearing unit for oilfield drilling fluids of the present inventions.
Figure 2:
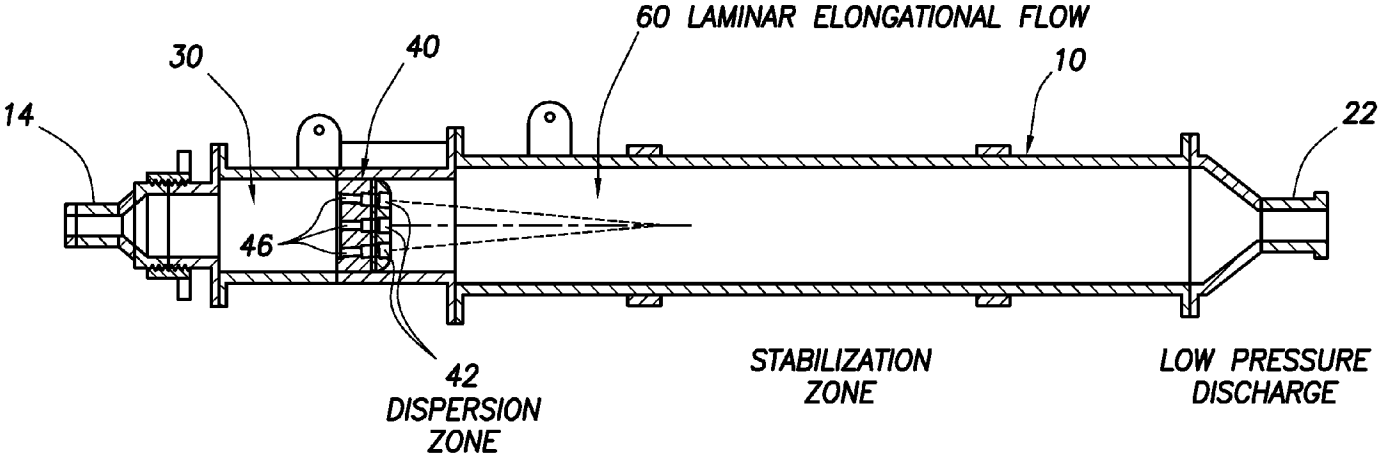
FIG. 2 illustrates a longitudinal cross-sectional view of the shearing unit of FIG. 1.

Referring now to the drawings, wherein like or corresponding parts are designated by like or corresponding reference numbers throughout the several views, there is illustrated, in FIGS. 1 and 2, an embodiment of the high energy in-line hydraulic shearing unit for oilfield drilling fluids, which for purposes of description is identified generally by reference numeral 10. As used herein, the term "drilling fluids" refers to fluid mixtures of polymers, solids and liquids inserted into the well during drilling and completion activities and includes, for example, drilling "mud."

In this embodiment, the elongated shearing unit 10 in the form of a hollow body is illustrated mounted on a skid 12 allowing it to be moved to shear drilling mud at a remote land or offshore well site or in a staging yard. Input connection 14 communicates with the interior of the shearing unit 10 for supplying drilling fluids to the shearing unit 10. In this case, input connection 14 is a high pressure hammer union, allowing high pressure supply tubing 16 to be connected to a pump 18. Also, in this embodiment, the pump selected is a high pressure triplex positive displacement pump capable of pumping drilling fluid mixtures from a supply 20 at a supply pressure preferably of approximately 2200 psig in the range of at least about 1000 to 3000 psig. In other embodiments, the shearing unit 10 can be a skid, trailer or truck, mounted with the pump 18.

Shearing unit 10 has a low pressure threaded discharge connection 22 coupled to discharge tubing 24. The discharge tubing can be connected to supply mixed and sheared drilling fluid to a mud pit or to the wellbore. The shearing unit 10 includes an input chamber 30 connected to input connection 14 and a walled or enclosed stabilization chamber 60 connected to discharge connection 22. Positioned between input chamber 30 and the stabilization chamber is a nozzle assembly 40. Fluid flowing into input chamber 30, is divided to flow through a plurality of nozzles 42 in the nozzle assembly 40 where shearing takes place and then into the stabilization chamber where the emulsifiers in the fluid inhibit the droplets just formed from coalescing.

Figure 3:
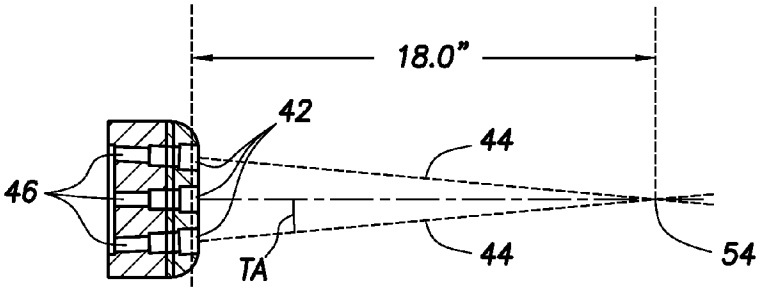
FIG. 3 is a diagram illustrating the fluid flow direction through the nozzles of the present inventions.

According to a particular feature of the present invention, as illustrated in FIG. 3, the streams 44 discharged from nozzles 42 are directed into the stabilization chamber 60. In this embodiment, the nozzles 42 (four in number) are adjacent and set 90 degrees apart with their streams aligned to intersect in the stabilization chamber 60.

The phrase "aligned to intersect" is used to describe the situation where substantial portions of the discharges from the nozzles will enter and interact in turbulent flow in a common area downstream in the stabilization chamber. The area of intersection of the streams is spaced away from the walls of the chamber 60 to reduce or eliminate erosion of the chamber walls.

The nozzles 42 are removable, mounted by threads in bores 46 formed in the nozzle assembly 40. In this embodiment, the nozzles are in the range of about 9/32" and are convergent-divergent nozzles. In this embodiment, the tilt angle ("TA") of each nozzle 42 is in the range of 2 to 10 degrees and preferably about 5 degrees. At that TA with the nozzles spaced 1.65" off center, the nozzle streams 44 intersect about 18" downstream of the nozzles. It is envisioned that other configurations of nozzles with discharges that intersect could be used. More or less than four nozzles may be used in other iterations of this design. For example, the discharge from two nozzles could intersect in an area downstream along the center line of the chamber. An additional third nozzle's discharge could be aligned with its discharge, extending along center of the chamber to intersect with the discharge from the two nozzles. In another example, a plurality of sets of nozzle could be aligned to intersect at different points spaced downstream of the nozzles.

In the illustrated embodiment, stabilization chamber 60 comprises a five-foot-long, ten inch internal diameter section of tubing. The internal volume of the walled or enclosed chamber allows static pressure in chamber 60 to remain relatively low preferably about 30 psig and in the range of about 10 to no more than about 150 psig. This configuration of passing fluid through inward intersecting nozzles while lowering the fluid pressure from a relatively high pressure to a relatively low pressure aids droplet disruption and reduces erosion in the stabilization chamber 60. This pressure reduction allows the low pressure discharge 24 to be safely routed into a low pressure rated manifold or atmospheric storage tank.

Figure 4:
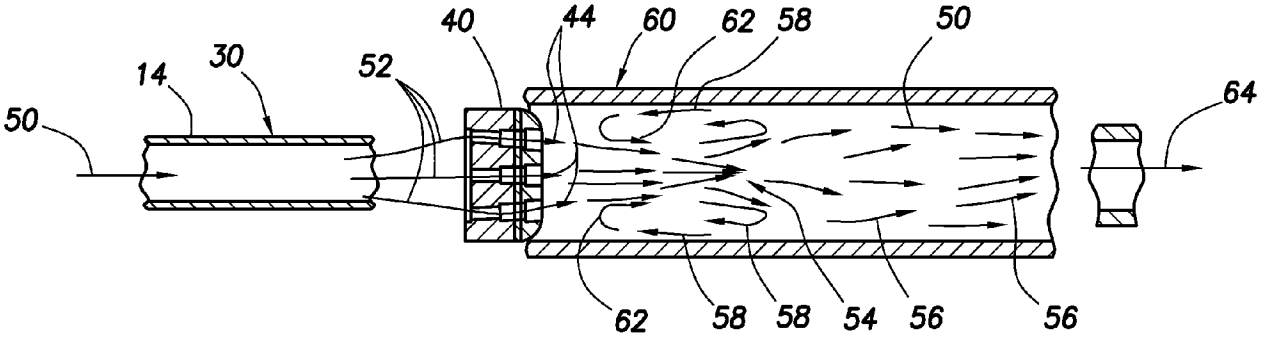
FIG. 4 is a diagram illustrating the fluid flow path through the shearing unit of the present inventions.

In FIG. 4, some steps of the method of using the shearing unit 10 or the present invention are described by illustrating flow of drilling fluid through the shearing unit 10 in graphic form. The drilling fluid constituents are combined and pumped input chamber 30 at a high pressure as input flow 50. Input flow 50 is divided into four flow segments 52 by the bores 46. While passing through nozzles 42, the four segments 52 are reduced in pressure and accelerated through as they pass through nozzles 42 to become streams 44.

The streams 44 enter the low pressure stabilization chamber 60 where they generally intersect in an area 54 where additional mixing occurs. Part of the flow leaves the intersecting area 54 and moves downstream toward the discharge connection 22, as illustrated by part of flow 56. Another part of the flow leaving the intersecting area 54 flows back along the chamber walls as illustrated by recirculating part of flow 58. This backflow is pulled into the streams 44 as illustrated by portion pulled into the discharge 62. Upon entry into the stabilization chamber 60, the drilling fluid is reduced in pressure equivalent to the pressure of the sheared drilling fluid 64 exiting the chamber. The mixed and sheared drilling fluid exiting the shearing unit 10 can then be directed into a mud pit or through a standard low pressure hose into storage or other well operations.

Figure 5:
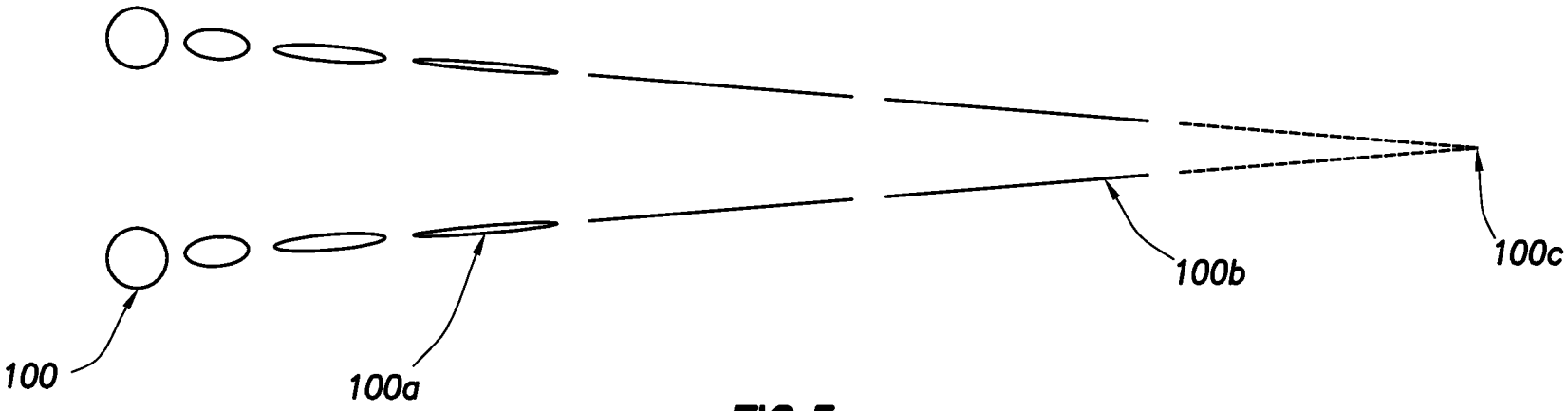
FIG. 5 is a diagram illustrating disruption of the droplets in the fluid flow through the shearing unit of the present inventions.

In FIG. 5 shearing of the individual water and emulsion droplets in the segments is graphically illustrated. As droplets 100 accelerate through nozzles 40, they experience laminar elongational flow wherein the droplets become elongated droplets 100*a*. As the droplets move to the nozzle discharge, the droplets break or divide into smaller droplets 100*b*. Thereafter, the droplets 100*c* enter stabilization zone 60 where the increased surface area is brought into contact with emulsifiers dissolved within the continuous phase (oil) to interact and prevent the droplets from coalescing.

The method of the present invention, demonstrates passing two dissimilar liquids with different surface tensions through a nozzle at high velocity and pressure with adequate energy to allow the droplets to elongate and eventually separate into much smaller droplets. The flow containing the smaller droplets has a larger total surface area which attracts the emulsifier in the stabilization zone, thereby preventing the droplets from coalescing.

Materials

It is to be understood, as known to those of ordinary skill in the relevant art field, nozzles 42 can be made of tungsten carbide or other durable materials, and the interior of the stabilization chamber 60 can be coated with tungsten carbide to reduce erosion. However, the shearing unit may be made of suitable materials well known to those of ordinary skill in the relevant art, such as high-strength steel alloys, resilient parts for seals, etc.

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is not to be limited to the illustrative examples set forth above, but encompasses modifications which may become apparent to those of ordinary skill in the relevant art.

What is claimed is:

1. A method of shearing an invert well fluid and flowing a well fluid into a well, comprising:

forming a mixture comprising oil and water;

pumping the mixture into an input chamber at a high pressure;

dividing the mixture into a plurality of flow segments;

reducing a pressure of the plurality of flow segments by flowing the plurality of flow segments through a plurality of nozzles to reduce the size of and elongate the water droplets, wherein the nozzles comprise convergent-divergent nozzles;

discharging separate streams of the plurality of flow segments from the plurality of nozzles into a low-pressure stabilization chamber;

intersecting the separate streams in the low-pressure stabilization chamber to form an emulsified invert well fluid; and flowing the emulsified invert well fluid from the low-pressure stabilization chamber through a low pressure fluid outlet into the well.

2. The method of claim 1, wherein the plurality of nozzles comprises at least two nozzles.

3. The method of claim 1, wherein the plurality of nozzles comprises at least four nozzles.

4. The method of claim 1, wherein the separate streams intersect in an area spaced away from the walls of the low-pressure stabilization chamber.

5. The method of claim 1, wherein the mixture of emulsified invert well fluid comprises synthetic-based drilling fluid.

6. The method of claim 1, wherein the mixture forming step additionally comprises adding an additive selected from the group consisting of emulsifiers, rheology modifiers, filtration control agents, osmotic balance agents, wetting agents, base oils, organic polymers and surfactants.

7. The method of claim 1, wherein the droplets are reduced to less than 3 μm.

8. The method of claim 1, wherein the droplets are reduced to less than 1 μm.

9. The method of claim 1, wherein the nozzles are adjacent and inclined toward each other at about 2 to 10 degrees.

10. The method of claim 1, wherein the nozzles are adjacent and inclined toward each other at about 5 degrees.

11. The method of claim 1, wherein the step of flowing the plurality of flow segments from the low-pressure stabilization chamber into the well comprises flowing the emulsified invert well fluid into a tank and thereafter flowing the emulsified invert well fluid into the well.

12. The method of claim 1, wherein the step of flowing the emulsified invert well fluid from the low-pressure stabilization chamber into the well comprises pumping the emulsified invert well fluid into the well.

13. The method of claim 1, additionally comprising:

flowing the fluid mixture from a fluid inlet into a hollow body and into the nozzles.

14. An apparatus for shearing an invert well fluid prior to insertion into a well comprising:

a hollow body coupled to a high pressure fluid inlet and a low-pressure fluid outlet;

an input chamber coupled to the high pressure fluid inlet, wherein fluid flowing into the input chamber is at a high pressure;

a plurality of nozzles coupled to the input chamber, each creating a nozzle discharge stream from fluid flowing to the plurality of nozzles from the input chamber, positioned in the hollow body to divide the well fluid from the high pressure fluid inlet into a plurality of streams;

a low-pressure stabilization chamber disposed between the nozzles and the low-pressure fluid outlet;

wherein the low-pressure fluid outlet is fluidically coupled to the well;

wherein the nozzles comprise convergent-divergent nozzles;

wherein the nozzles are of a size and shape to reduce the size of and elongate the well fluid droplets as they flow through the plurality of nozzles, and wherein the nozzles are mounted such that the plurality of streams intersect in the low-pressure stabilization chamber to form an emulsified invert well fluid.

15. The apparatus of claim 14, wherein said plurality of nozzles comprises four nozzles.

16. The apparatus of claim 14, wherein the nozzle discharge streams are adjacent and inclined toward each other at about 2 to 10 degrees.

17. The apparatus of claim 14, wherein the nozzle discharge streams are adjacent and inclined toward each other at about 5 degrees.

18. The method of claim 14, wherein the nozzles are removable from the hollow body.

19. The apparatus of claim 14, wherein the nozzles are removable from the hollow body.

* * * * *